US011371308B2

(12) United States Patent
Marsh et al.

(10) Patent No.: US 11,371,308 B2
(45) Date of Patent: Jun. 28, 2022

(54) APPARATUS FOR CONNECTING A TOOL STRING TO COILED TUBING IN DOWNHOLE OPERATIONS

(71) Applicant: Downhole Tools International Limited, Eastleigh (GB)

(72) Inventors: Brent Neal Marsh, Bournemouth (GB); Aaron Andrew Liam Robertson-Bee, Poole (GB)

(73) Assignee: DOWNHOLE TOOLS INTERNATIONAL LIMITED, Chandler's Ford (GB)

( * ) Notice: Subject to any disclaimer, the term of this patent is extended or adjusted under 35 U.S.C. 154(b) by 490 days.

(21) Appl. No.: 16/353,698

(22) Filed: Mar. 14, 2019

(65) Prior Publication Data

US 2019/0284895 A1 Sep. 19, 2019

(30) Foreign Application Priority Data

Mar. 14, 2018 (GB) ..... 1804052

(51) Int. Cl.
*E21B 17/02* (2006.01)
*E21B 33/04* (2006.01)

(52) U.S. Cl.
CPC ..... *E21B 33/0422* (2013.01); *E21B 17/02* (2013.01); *E21B 2200/01* (2020.05)

(58) Field of Classification Search
CPC ..... E21B 17/02; E21B 17/04; E21B 17/041; E21B 33/0422; E21B 2200/01
See application file for complete search history.

(56) References Cited

U.S. PATENT DOCUMENTS 5,452,923 A * 9/1995 Smith ..... E21B 17/04 166/378
5,996,695 A 12/1999 Koleilat et al.
6,439,618 B1 * 8/2002 Beeman ..... E21B 17/04 166/242.2
6,481,498 B1 * 11/2002 Ackroyd ..... E21B 17/04 166/242.6
7,011,344 B1 * 3/2006 Bakke ..... E21B 17/04 285/374
7,498,509 B2 * 3/2009 Brotzell ..... E21B 17/02 174/21 R

FOREIGN PATENT DOCUMENTS

EP 0681085 A2 5/1995
GB 2257180 A 1/1993
GB 2505469 A * 3/2014 ..... F16L 15/08

OTHER PUBLICATIONS

Great Britain Search Report from GB Appl. No. GB 1804052.7, dated Jul. 23, 2018.

* cited by examiner

*Primary Examiner* — Matthew R Buck
(74) *Attorney, Agent, or Firm* — Wood IP LLC

(57) ABSTRACT

A connection between a downhole tool string and axially extending coiled tubing 102 includes a compression ring 120 that in use grips the coiled tubing sufficiently to enable a slip ring to be set and provides a satisfactory seal with the coiled tubing 102. The compression ring 120 is preferably of a relatively malleable metal and includes a skirt 142 of reduced thickness to be preferentially compressible and which in use is compressed against the coiled tubing 102.

10 Claims, 7 Drawing Sheets

APPARATUS FOR CONNECTING A TOOL STRING TO COILED TUBING IN DOWNHOLE OPERATIONS

CROSS-REFERENCE TO RELATED APPLICATIONS

Reference is made to British Patent Application No. 18 04 052.7 filed Mar. 14, 2018, to which priority is claimed and which is incorporated herein by reference in its entirety.

This invention concerns apparatus for connecting a tool string to coiled tubing in a wellbore, particularly but not necessarily exclusively for downhole use in oil and gas wells.

The description of the invention which follows makes use of imperial units (which for the purposes hereof may be deemed equivalent to United States customary units). This is contrary to official requirements in some jurisdictions—for instance the EC Units of Measurement Directive (Council Directive 80/181/EEC, as amended by Council Directive 89/617/EEC and Directive 1999/103/EC of the European Parliament and of the Council of 24 Jan. 2000)—but it is meaningful to those skilled in the art because it accords with general practice in oilfield operations. Thus the following description commonly refers to inches (in) and pounds force per square inch (psi) as such units are more familiar to those skilled in oilfield and other downhole operations than SI equivalents such as millimetres (mm) and kilopascals (kPa). But for completeness approximate SI values are provided from 1 in =25.4 mm and 1 psi=6.895 kPa.

Coiled tubing formed of steel (commonly carbon steel but possibly stainless) is very widely used in oil and gas wells, for downhole interventions and other purposes. It comprises a continuous length of pipe of diameter typically from one inch up to several inches, unwound from a reel and pushed down into the wellbore to carry pressurised liquid or gas. Tool strings are connected to the coiled tubing as and where required, and those skilled in the art will appreciate that the connection must both hold the tool string securely (to prevent its becoming detached and possibly lost, delaying production and/or necessitating costly and time-consuming recovery operations) and provide an effective seal between the tool string and the pressurised liquid or gas flow path.

Various connection arrangements are known for holding the tool string securely on the coiled tubing. And apart from the occasional use of weld-on connections in special applications, downhole coiled tubing connections can be grouped under two main headings, viz non-yielding and yielding.

As characterised by the Society of Petroleum Engineers, a non-yielding connection secures coiled tubing in a manner that does not cause yielding of the tubing body when the connection is made. Non-yielding connections have slips with teeth that bite into the coiled tubing, either externally or internally.

A yielding connection secures coiled tubing in a manner that causes the coiled tubing body to yield when the connection is made. A common form of yielding connection, known as the dimple type, has set screws received in dimples formed in the coiled tubing, either externally or internally, by a tool applied to the coiled tubing with a force greater than its yield strength. Another form of yielding connection is that known as the roll-on type, in which a machined mandrel formed with circular recesses is configured and arranged to fit within the prepared inner diameter of the coiled tubing, which is then rolled onto the mandrel with a force sufficient to cause it to yield and enter the recesses.

Those skilled in the art will appreciate that connections with the coiled tubing require pressure integrity to be maintained, and this is typically done by means of O-rings or other kinds of elastomeric seals such as packing elements or Vee-packings separate from the connector itself (the function of which is to make a secure mechanical connection). The Society of Petroleum Engineers points out common problems in fitting such seals including distortion (lack of roundness) of the coiled tubing, diametral growth of the coiled tubing, roughness on the surface (inner and/or outer) of the coiled tubing and protrusion of the seam formed in making the coiled tubing.

Another problem is that whilst elastomeric seals are satisfactory where the environment is comparatively benign, at downhole locations high temperatures and pressures and the possible presence of deleterious chemicals such as sour gas make for a hostile environment in which elastomeric seals may become degraded. For this reason the present invention proposes a metal seal in a downhole connection between coiled tubing and a tool string.

It is known to use a metal seal at a wellhead. For instance, U.S. Pat. No. 5,996,695 (FMC) offers a metal-to-metal seal between the relatively rough outer surface of an upwardly extending casing stub (as distinct from coiled tubing) and the opposed inner surface of a tubing head (as distinct from a tool string). But FMC makes no suggestion of providing metal seals between coiled tubing and a tool string in downhole connections.

In addition it should be noted that wellhead structures are much more massive than those of the downhole coiled tubing connections of the present invention. In FMC the casing string has an overall diameter of 9.625 in (244.5 mm), a standard size with a wall thickness of 0.472 in (12 mm) (American Petroleum institute Specification 5C3). Therefore the casing stub of FMC is easily able to withstand substantial squeezing loads on the metal seal. By contrast, the coiled tubing to which the present invention relates may be as small as 1.0 in overall diameter with a wall thickness as little as 0.125 in (3.2 mm). It follows that the technology of FMC cannot be expected to transfer directly to the present invention.

It is an object of the present invention to provide an improved connection between coiled tubing and a tool string downhole.

Thus according to the invention there is provided apparatus for connecting a tool string to axially extending coiled tubing, which apparatus comprises:

a first body of hollow circular form configured and arranged to be positioned concentrically with the coiled tubing;

a compression ring configured and arranged to extend around the coiled tubing between said first body and the coiled tubing and concentric with both, which compression ring is of a metal having a lower yield strength than that of the first body and the coiled tubing; and compressive means operative to compress the compression ring against the coiled tubing, to grip it and provide a seal therewith;

characterised in that said compression ring is formed with a skirt of reduced thickness which is thereby preferentially compressible against the coiled tubing by said compressive means.

Preferably the compression ring is malleable relative to the coiled tubing and the first body of the apparatus (ie of material having a lower yield strength than the material(s) of the coiled tubing and said first body) so that it can be compressed against the coiled tubing by the first body.

Other features of the invention will be apparent from the following description, which is made by way of example only and with reference to the accompanying schematic drawings in which.

Figure 1:
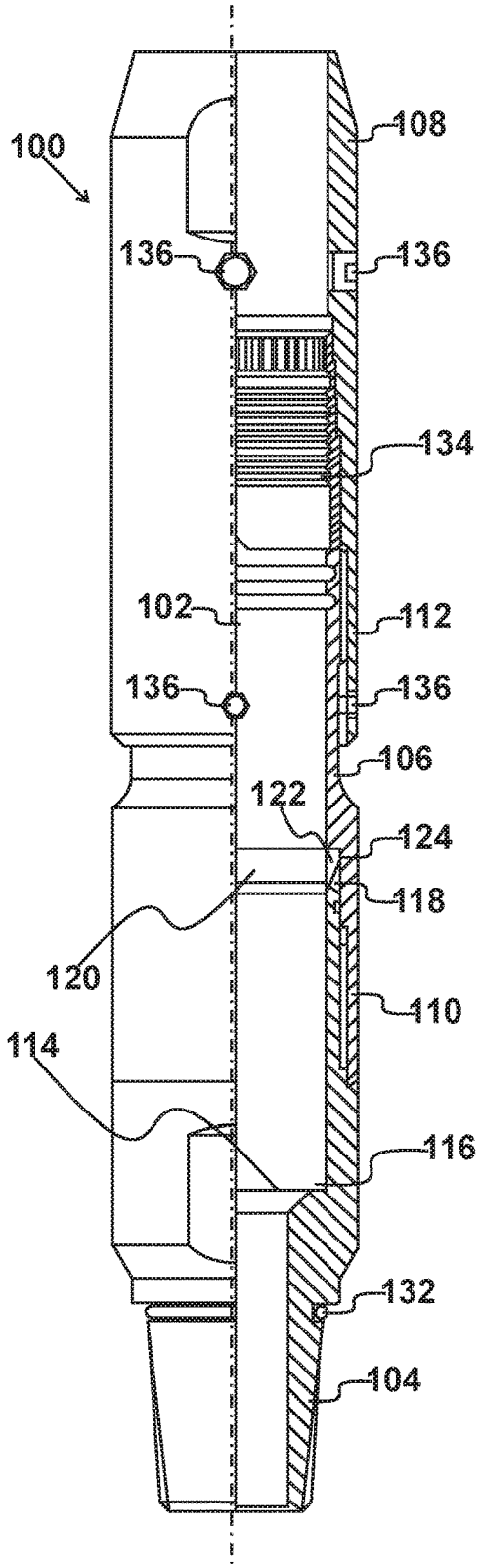
FIG. 1 shows in half-section apparatus for connecting a tool string to axially extending coiled tubing according to the invention.

Referring first to FIG. 1 the connecting apparatus 100 of the invention is shown applied to steel coiled tubing 102 extending axially downwards as in a wellbore (not detailed). The apparatus 100 comprises a first (lower) body 104 of hollow circular form, a second (intermediate) body 106 of hollow circular form and a third (upper) body 108 of hollow circular form. The first body 104 is engaged with the second body 106 by way of a screw thread 110 and the second body is engaged with the third body 108 by means of a screw thread 112 so that the first, second and third bodies 104, 106 and 108 together form a generally tubular housing extending axially and in use concentric with the coiled tubing 102.

The coiled tubing 102 extends downwards through the third and second bodies 108 and 106 and its end 114 abuts an internal shoulder 116 of the first body 104. The top of the first body 104 is formed with an annular face 118 extending upwardly and outwardly at an inclination to the axial direction (ie, at an angle to the longitudinal axis A-A of the coiled tubing 102).

Extending around the coiled tubing 102 and above its end 114 is a compression ring 120 having an outer circumference in the form of an annular face 122 extending outwards and upwards and inclined at an angle to the axial direction. The annular face 122 of the compression ring 120 opposes the annular face 118 of the first body 104 but is inclined to the axial direction at an angle different from the angle of the annular face 118 of the first body 104. (The relative configuration will be described in more detail hereinafter with reference to FIGS. 6 and 7).

Figure 2:
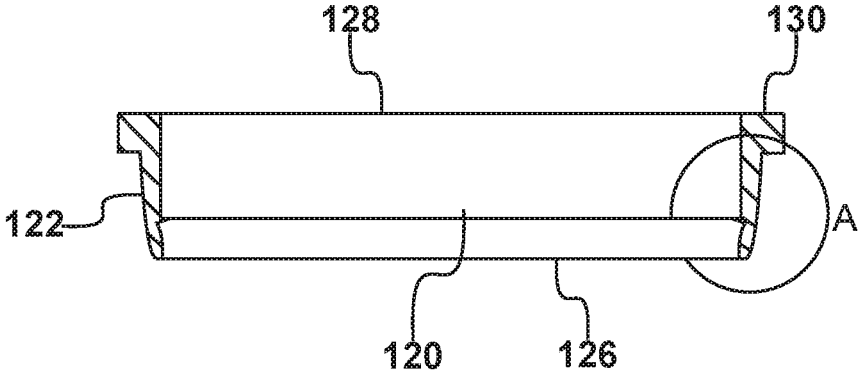
FIG. 2 illustrates a compression ring of the apparatus of FIG. 1, in vertical cross section and enlarged relative to FIG. 1.
Figure 3:
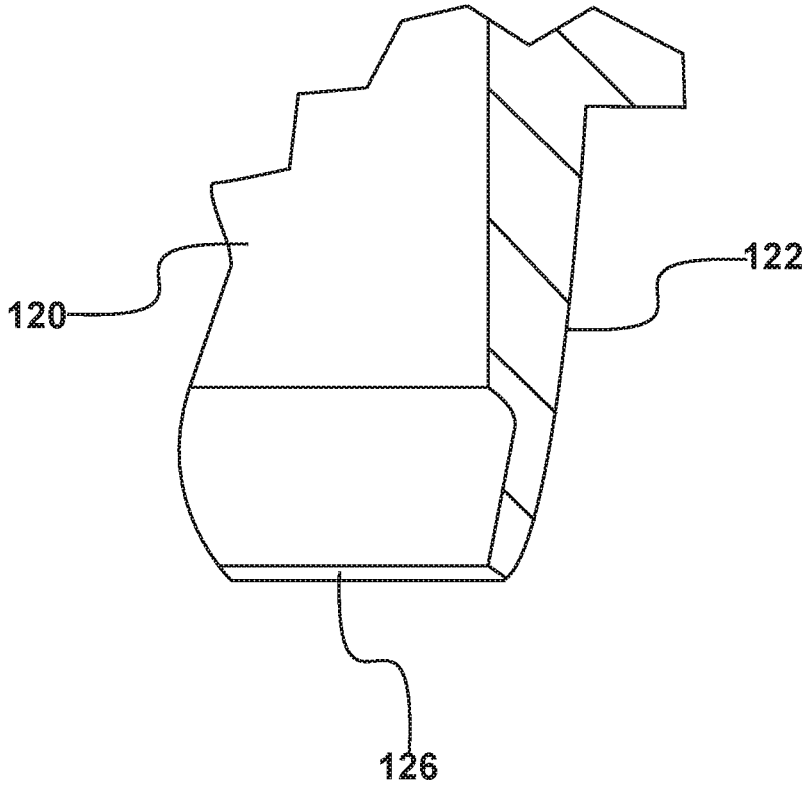
FIG. 3 shows a detail as at A of FIG. 2, further enlarged.
Figure 4:
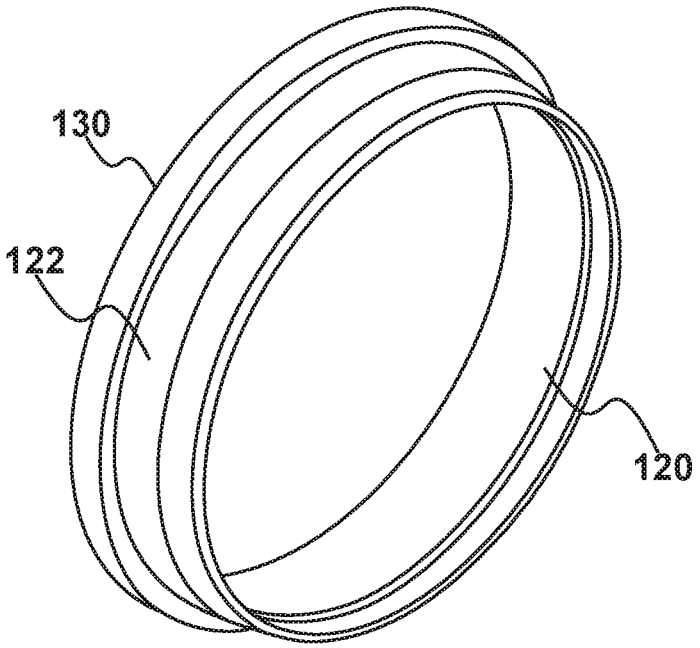
FIG. 4 is an isometric view of the compression ring.

The form of the compression ring 120 is shown more clearly in FIGS. 2 to 4. It will be noted that the bottom 126—from which the annular face 122 extends upwards and outwards—is narrowed to receive the annular face 118 of the first body 104 (FIG. 1). Also, the top 128 projects outwardly in the form of a stop 130 that in use engages the second body 106. The compression ring 120 is formed of stainless steel malleable relative to the steel of at least the first and second bodies 104 and 106 and the coiled tubing 102.

In use, the first body 104 and the second body 106 are screwed together by way of the screw thread 110 so that the annular face 118 of the first body 104 is driven progressively against the annular face 122 of the compression ring 120. This causes the compression ring 120, with its relatively low yield strength, to be compressed against the coiled tubing 102 (which has a substantially higher yield strength) to grip the coiled tubing 102 and provide a seal with it.

For completeness, other details of the apparatus as shown in FIG. 1 may now be noted. The lower end of the first body 104 is formed for the attachment of a tool string (not shown) and includes an O-ring 132 for sealing engagement therewith. A slip ring 134 sits on top of the second body 106 and within the third body 108, and the second body 106 and the third body 108 can be screwed together by means of the screw thread 112 so that the slip ring 134 is driven into biting engagement with the coiled tubing 102. And for additional security the third body 108 is held against the coiled tubing 102 and the second body 106 by set screws 136.

Before attaching the apparatus 100 to the coiled tubing, all parts are checked for wear or damage and repaired or replaced if necessary. The end 114 of the coiled tubing is cut and dressed so that it is smooth and free from burrs and/or corrosion pitting, and it is preferably chamfered to guard against damage to the compression ring 120 when that is fitted.

The first step in assembling the apparatus 100 is to slide the third body 108 onto the coiled tubing 102, to a position a short distance above the end 114 of the coiled tubing. Then the slip ring 134 (opened up slightly, if necessary, by careful levering) is slid onto the coiled tubing 102, after which the second body 106 is pushed onto the coiled tubing 102 to engage the slip ring 134. Next the compression ring 120, preferably greased to facilitate its movement, is slid onto the coiled tubing and upwards until its stop 130 engages a shoulder 124 on the second body 106. The first body 104 and the second body 106 are then screwed together hand tight. After this, the slip ring 134 is pushed back down the coiled tubing 102 until it engages the top of the second body 106, and then the first body 104 and the second body 106 are screwed together fully, which begins the compression of the compression ring 120. Then the third body 108 is screwed tightly onto the second body 104. The apparatus 100 is then pulled downwards with a force sufficient to set the slip ring 134, during which procedure the grip of the slip ring 134 on the coiled tubing 102 is strong enough to prevent axial movement of the apparatus 100 by more than ¼ in, which does not interfere with the proper setting of the slip ring 134. The first body 104 and the second body 106 are then screwed together tightly to complete the compression of the compression ring 120.

Figure 5:
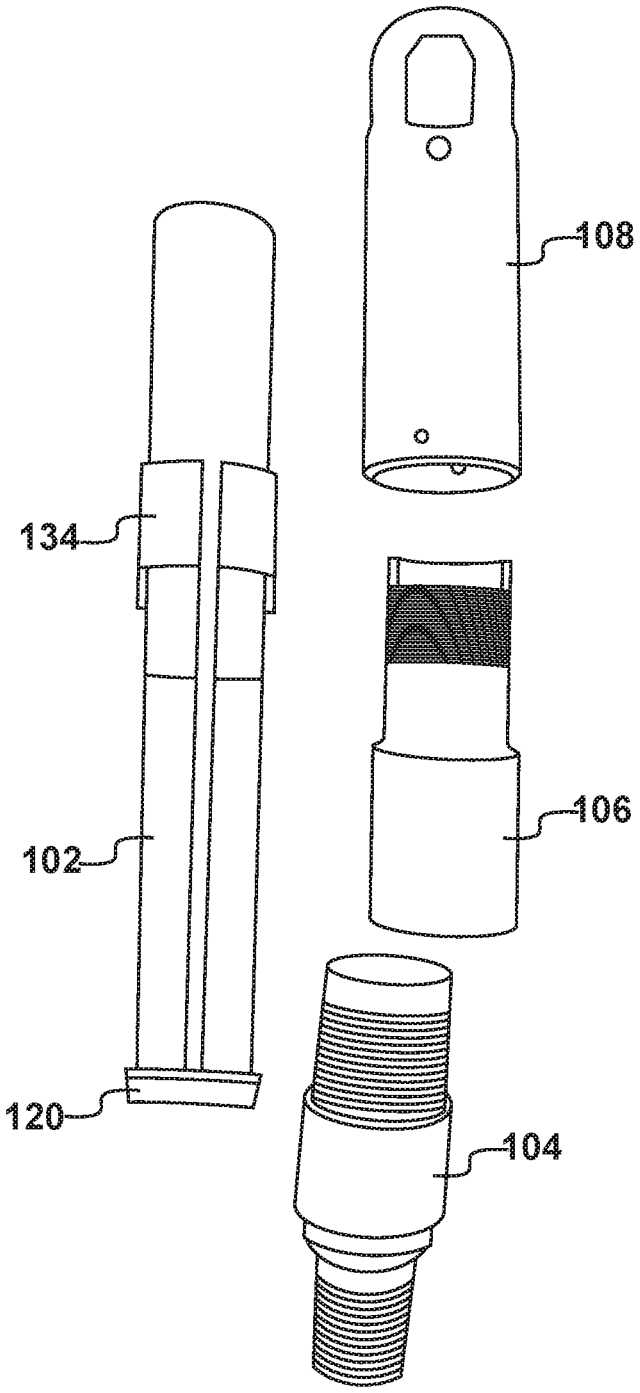
FIG. 5 shows components of the apparatus of FIG. 1 disassembled after testing on a length of coiled tubing.

FIG. 5 shows components of apparatus 100 disassembled after (successful) tests on a sample of coiled tubing as described below, and comprising: the coiled tubing 102; the slip ring 134 on the coiled tubing 102; the compression ring 120 on the end of the coiled tubing 102; the first body 104; the second body 106; and the third body 108. In the apparatus 100 as tested: the compression ring 120 was formed of AISI-SAE 316 stainless steel with a yield strength of 42000 psi (289590 kPA); the first, second and third bodies 104, 106 and 108 were formed of AISI-SAE 4140 carbon steel having a substantially higher yield strength of 60000 psi (413,700 kPa); and the coiled tubing was of QT800 steel having a yet higher yield strength of 80000 psi (551600 kPa).

The test apparatus was assembled on a sample of coiled tubing 102 which was filled with hydraulic oil and, after clearing any bubbles of air etc, subjected to a pressure of 5000 psi (34475 kPa). During the next 15 minutes it was observed that there was a pressure drop of only 45 psi (310 kPa), which is less than 1%. A further test at 10000 psi (68950 kPa) showed a pressure drop of only 57 psi (393 kPa), also less than 1%. In the absence of an API standard for coiled tubing tool or connector testing, a pressure drop of less than 1% is considered to indicate an effective pressure barrier.

Inasmuch as the compression ring of the invention is said herein to grip the coiled tubing and provide a seal therewith, this should be understood to mean that the grip is sufficient to allow a slip ring to be adequately set and that the seal forms an effective pressure barrier.

Figure 6:
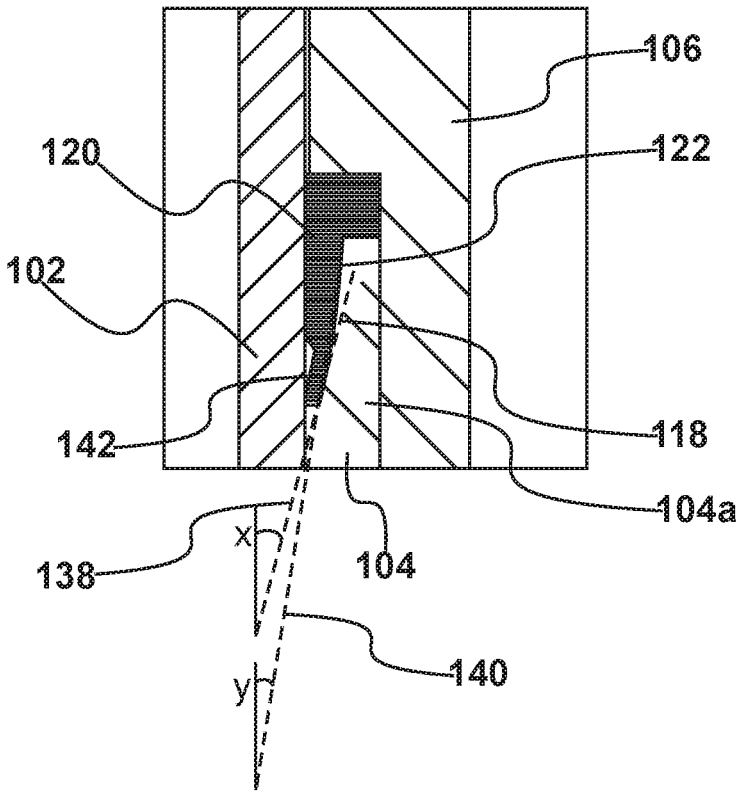
FIGS. 6 and 7 illustrate to a much enlarged scale the compression ring of FIG. 4, respectively before and after compression.
Figure 7:
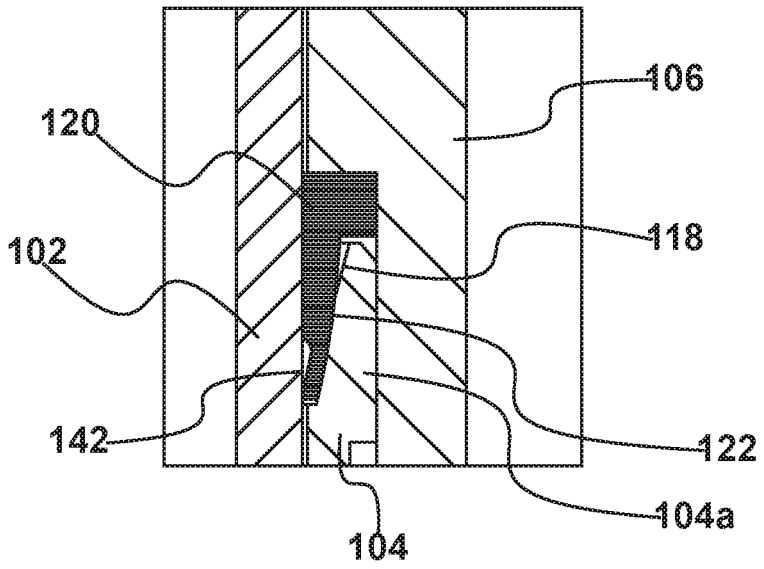

FIGS. 6 and 7 are enlarged partial cross-sections illustrating the form of the compression ring 120 before (FIG. 6) and after (FIG. 7) compression. FIGS. 6 and 7 show the wall of the coiled tubing 102, the second body 106 and the top 104*a* of the first body 104 with its annular face 118 extending upwardly and outwardly at an inclination to the axial direction as indicated by the projecting broken line 138 of FIG. 6. The compression ring 120 has an outer circumference in the form of an annular face 122 extending outwards and upwards and inclined at an angle to the axial direction as indicated by the projecting broken line 140 of FIG. 6. The annular face 118 of the first body 104 opposes the annular face 122 of the compression ring 120 and it will be noted that the angle of inclination x of the annular face 118 is substantially greater than the angle of inclination y of the annular face 122. Thus the annular face 122 and the annular face 118 lie at different angles of inclination, and this difference facilitates the compression of the compression ring 120 when the first body 104 and the second body 106 are screwed together.

Two other features of the compression ring 120 should be noted with respect to FIGS. 6 and 7 as facilitating the compression of the compression ring 120 and the provision thereby of an effective pressure barrier. First, the annular face 122 is slightly curved to help the annular face 118 to run over it. And second, the compression ring 120 is formed with a comparatively thin skirt 142 around its lower edge which compresses more readily when engaged by the (harder) annular face 118.

The invention was devised particularly to facilitate coiled tubing interventions with tool strings in wellbore operations, and it is of special benefit in high pressure, high temperature (HPHT) well environments where elastomers in downhole tools are susceptible to failure. Here, high pressure means more than 10000 psi (68950 kPa) (or, alternatively defined, where the maximum anticipated pore pressure of a porous formation to be drilled exceeds a hydrostatic gradient of 0.8 psi/ft (18 Pa/mm)) and high temperature means an undisturbed bottom hole temperature, at prospective reservoir depth or total depth, greater than 300° F. (149° C.). HPHT environments are met in deep wells, long reach wells and thermal wells, all of which are becoming more common as new oil and gas resources are sought. And looking ahead, there will be more wells with extreme (>350° F. (177° C.), >15000 psi (103425 kPa)) and ultra (>400° F. (204° C.), >20000 psi (137900 kPa)) high pressure and temperature environments. By replacing an elastomer seal with a metal seal the invention thus contributes to improved resource management both now and in the future.

Those skilled in the art should also now appreciate that the use of the invention is not confined to downhole interventions with tool strings. For instance, it might be used where coiled tubing is hung into an oil well semi-permanently as a feature within the production tubing, say to bridge a section of pipe that is worn, corroded or leaking. Otherwise coiled tubing may be used to reduce the effective internal diameter of a wellbore so as to increase fluid flow velocity, eg where liquids from oil wells approaching the end of production have insufficient velocity for extraction, in which case a velocity string of coiled tubing can be run into the wellbore as an economic way of continuing production.

The invention claimed is:

1. An apparatus for connecting a tool string to an axially extending coiled tubing, the apparatus comprising:

a first body having a hollow circular form and arranged concentrically with the axially extending coiled tubing;

a compression ring (i) extending around the axially extending coiled tubing between the first body and the axially extending coiled tubing and (ii) being concentric with the first body and the axially extending coiled tubing;

wherein the compression ring is (i) a metal having a lower yield strength than that of the first body and the axially extending coiled tubing and (ii) malleable relative to the axially extending coiled tubing and the first body;

and a compressive means configured to (i) compress the compression ring against the axially extending coiled tubing (ii) grip the axially extending coiled tubing and (iii) provide a seal therewith;

wherein the compression ring is formed with a skirt of reduced thickness, the skirt being compressible against the axially extending coiled tubing by the compressive means.

2. The apparatus as claimed in claim 1, wherein the metal of the compression ring is stainless steel.

3. The apparatus as claimed in claim 1, wherein the compressive means comprises an annular face formed in the first body and inclined relative to an axial direction that in use engages the skirt to compress the skirt against the coiled tubing.

4. The apparatus as claimed in claim 3, wherein the skirt is formed with an annular face opposing the annular face of the first body.

5. The apparatus as claimed in claim 4, wherein the annular face of the skirt is inclined relative to the axial direction at an angle different from the angle of the annular face of the first body.

6. The apparatus as claimed in claim 3, wherein the apparatus comprises a second body of material similar to that of the first body, the second body being (i) of a hollow circular form (ii) screw-threadedly engage with the first body and (iii) rotatable thereon to effect relative axial movement between the first body and the second body, and wherein the compressive means comprises an annular shoulder on the second body between which the annular face of the first body and the skirt is compressed during the relative axial movement.

7. The apparatus as claimed in claim 6, wherein during operation, the second body is axially above the first body.

8. The apparatus as claimed in claim 6, wherein the apparatus includes one or more O-rings or the like, providing a seal between the tool string and the coiled tubing.

9. The apparatus as claimed in claim 6, further including a third body of hollow circular form being arranged axially above the second body during operation and screw-threadedly engaged therewith.

10. The apparatus as claimed in claim 9, wherein the third body is axially arranged via a slip ring and a plurality of set screws.

* * * * *